US006692070B1

(12) United States Patent
Hou et al.

(10) Patent No.: US 6,692,070 B1
(45) Date of Patent: Feb. 17, 2004

(54) FOOD TRAY ADJUSTMENT STRUCTURE FOR HIGH CHAIR

(75) Inventors: Jen-En Hou, Chia-I Hsien (TW); Chien-Min Tsai, Chia- I Hsien (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 10/270,051

(22) Filed: Oct. 15, 2002

(51) Int. Cl.[7] ..... A47B 39/00
(52) U.S. Cl. ..... 297/153; 297/151; 297/149
(58) Field of Search ..... 297/149, 151, 297/153

(56) References Cited

U.S. PATENT DOCUMENTS

| | | | | |
|---|---|---|---|---|
| 4,807,928 A | * | 2/1989 | Cone | 297/153 |
| 5,087,097 A | | 2/1992 | Hehn | |
| 5,118,161 A | | 6/1992 | Slowe et al. | |
| 5,458,394 A | | 10/1995 | Nichols et al. | |
| 5,489,138 A | * | 2/1996 | Mariol et al. | 297/151 |
| 5,507,550 A | | 4/1996 | Maloney | |
| 5,527,090 A | * | 6/1996 | Cone, II | 297/149 |
| 5,586,800 A | | 12/1996 | Triplett | |
| 5,820,207 A | * | 10/1998 | Wang | 297/27 |
| 5,823,615 A | * | 10/1998 | Haut | 297/151 |
| 5,951,102 A | * | 9/1999 | Poulson et al. | 297/130 |
| 6,416,124 B1 | * | 7/2002 | Chen et al. | 297/149 |
| 6,419,312 B1 | * | 7/2002 | Flannery et al. | 297/149 |

FOREIGN PATENT DOCUMENTS

| | | |
|---|---|---|
| TW | 240409 | 2/1995 |
| TW | 252424 | 7/1995 |
| TW | 327300 | 2/1998 |

* cited by examiner

*Primary Examiner*—Peter M. Cuomo
*Assistant Examiner*—Sarah C. Burnham
(74) *Attorney, Agent, or Firm*—Birch, Stewart, Kolasch & Birch, LLP

(57) ABSTRACT

A food tray adjustment structure for a high chair to adjust the position of the food tray to suit children of different sizes includes a handle with longitudinal sections at two sides to form a biased sliding rail with a skew angle to couple with sliding docks that have coupling troughs formed with the same type of biased surfaces. The sliding docks may form a released or a latched position with coupling sections formed on the armrests at two sides of the chair. Thereby the distance between the backrest and the food tray may be adjusted to suit children of different sizes sitting on the chair.

6 Claims, 5 Drawing Sheets

FOOD TRAY ADJUSTMENT STRUCTURE FOR HIGH CHAIR

FIELD OF THE INVENTION

The invention relates to a food tray adjustment structure for a high chair that has a handle with two longitudinal sliding rails each forming a biased angle so that when the handle is moved linearly two sliding docks at two sides each with a coupling trough with a biased surface are pushed vertically to be released from the armrests at two sides so that the food tray may be adjusted easily.

BACKGROUND OF THE INVENTION

High chairs are commonly used by parents to feed young children. A conventional high chair generally consists of a frame, a seat and a food tray. The seat is for seating a child and may be moved upwards on the frame. The food tray rests on the seat for holding food.

There are various designs for high chairs disclosed in the prior art, such as ROC patent Nos. 240409, 252424, and 327300, and U.S. Patent Nos. 5,087,097, 5,118,161, 5,458,394, 5,507,550 and 5,586,800. Among them, ROC patent No. 240409, entitled "Food tray structure for high chair" and No. 327300, entitled "Food tray adjustment structure for high chair" disclose food tray structures that are fixed or adjustable.

SUMMARY OF THE INVENTION

The primary object of the invention is to provide a food tray adjustment structure for a high chair.

The food tray adjustment structure for a high chair according to the invention includes a pair of armrests located on two sides of the chair that each have a coupling section arranged in a plurality of straight means located on the outer side of each armrest, a food tray located between the two armrests which has a bottom side with guiding troughs and anchor blocks formed thereon for positioning the handle and the sliding docks, a ⊓-shaped handle located on the bottom side of the food tray in a parallel manner that is movable reciprocally and has two longitudinal sections at two sides each with one end forming a sliding rail skewed at a biased angle, and a pair of sliding docks mounted onto two sides of the bottom surface of the food tray. Each sliding dock has a coupling trough corresponding to the sliding rail and a latch lug corresponding to the coupling section of the armrest. The biased surface of the siding rail of the handle may push the sliding dock to enable the latch lug of the sliding dock to selectively engage with or separate from the coupling section of the armrest, thereby to adjust the relative distance of the food tray and the backrest.

The foregoing, as well as additional objects, features and advantages of the invention will be more readily apparent from the following detailed description, which proceeds with reference to the accompanying drawings. The drawings are only to serve for reference and illustrative purposes, and are not intended to limit the scope of the invention.

DESCRIPTION OF THE PREFERRED EMBODIMENT

Figure 1:
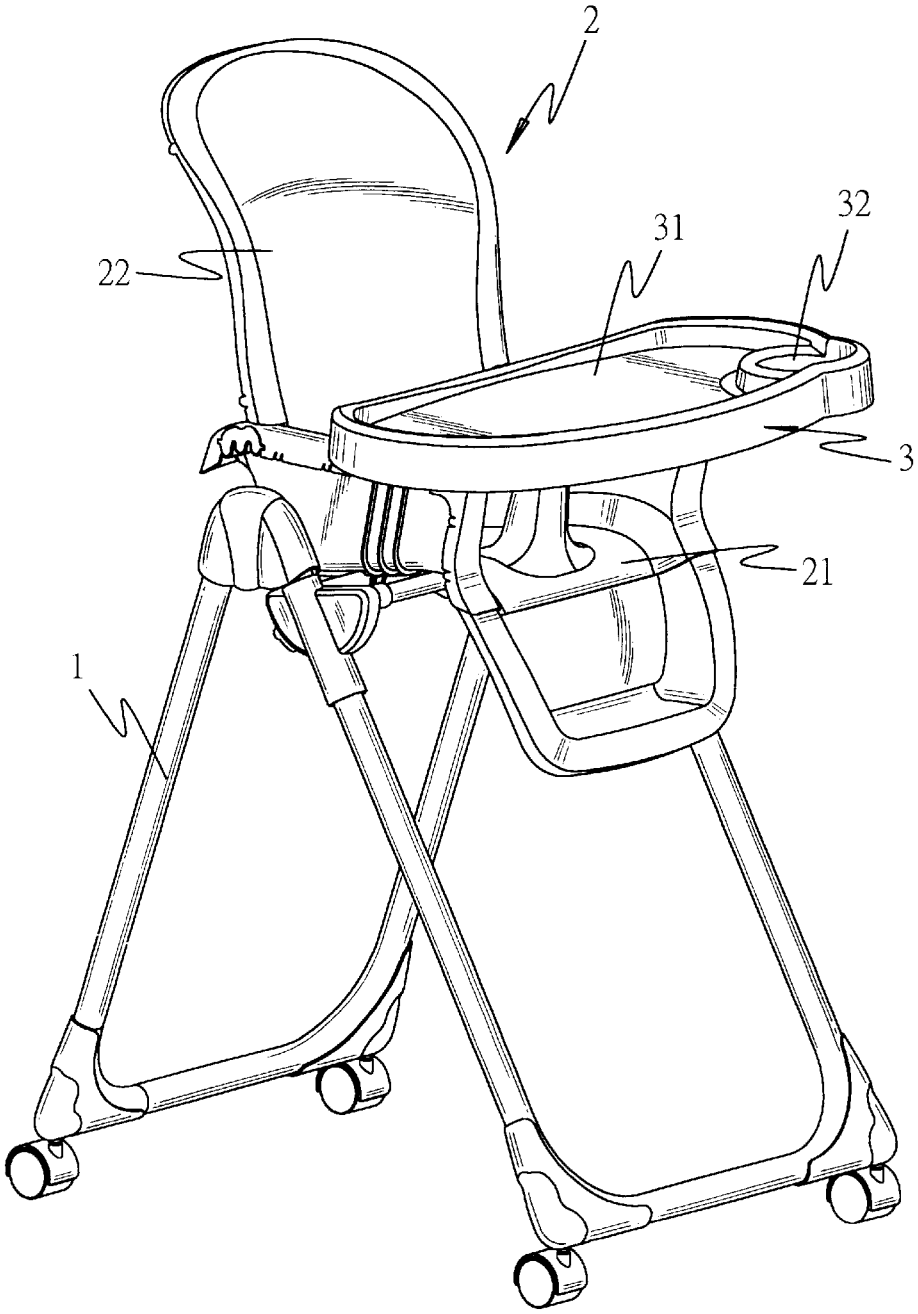
FIG. 1 is a perspective view of the invention.
Figure 2:
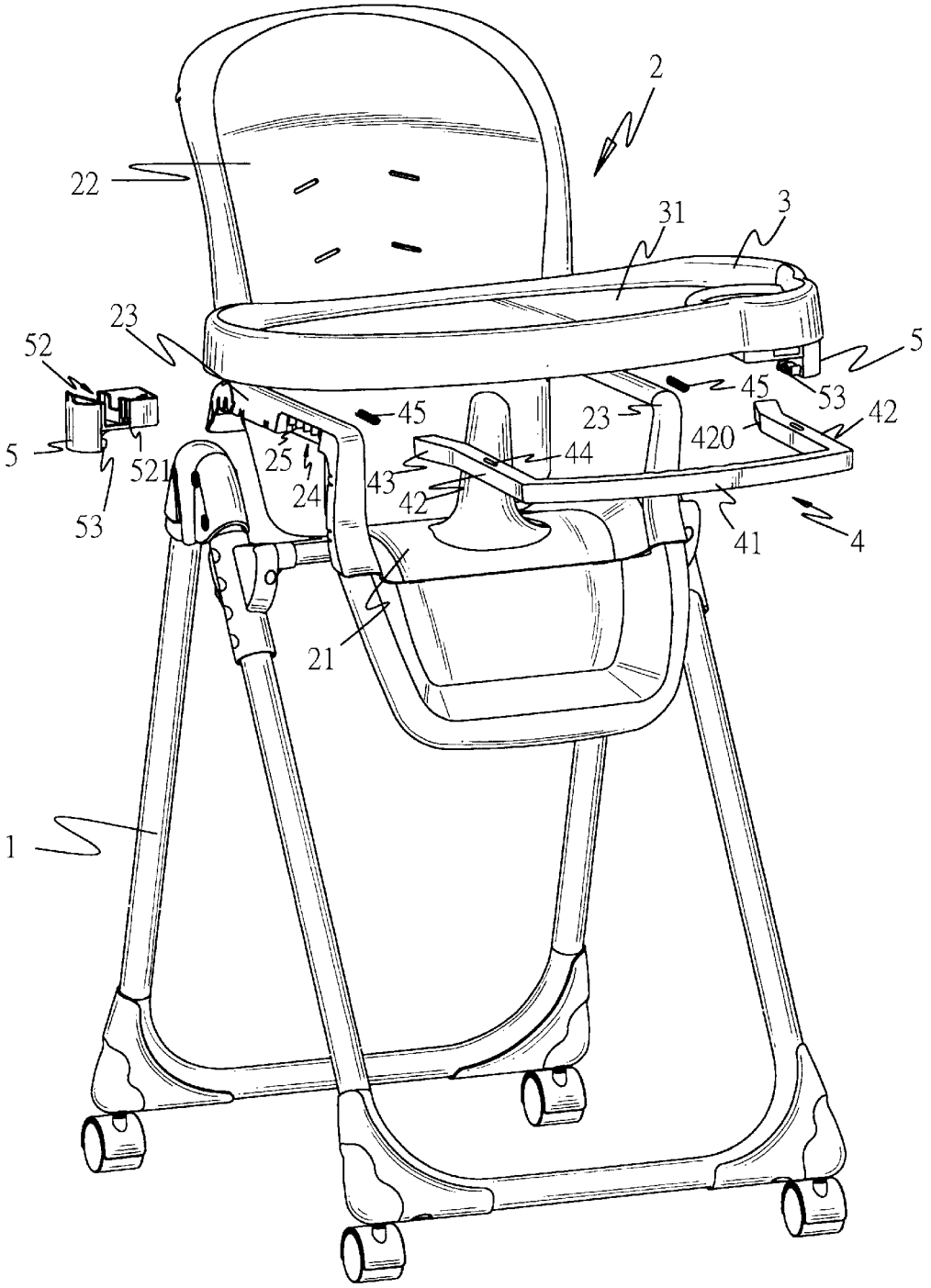
FIG. 2 is an exploded view of the invention.

Referring to FIGS. 1 and 2, the food tray adjustment structure for a high chair of the invention consists of a foldable frame 1 and a chair 2 for seating a child. The chair 2 includes a seat 21, a backrest 22 and two armrests 23 located on two sides. In an embodiment of the invention, the seat 21, backrest 22 and armrests 23 are integrally formed. The two armrests 23 are located on two sides of the seat 21. Each armrest 23 has an outer side with a coupling section 24 formed thereon that consists of a plurality of straight means. In an embodiment of the invention, the coupling section is formed in a plurality of spaced jutting ridges 25 to serve as positioning space.

Figure 3:
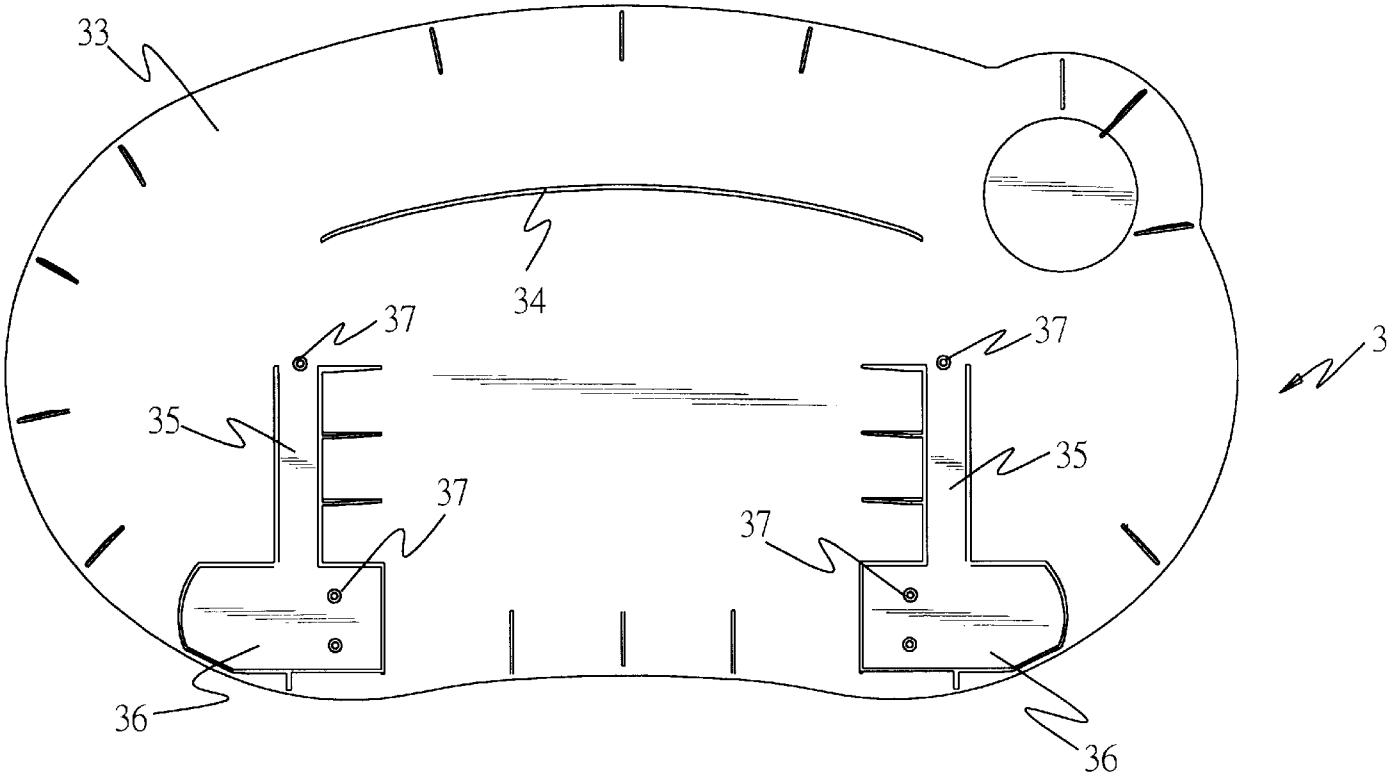
FIG. 3 is a bottom view of the food tray of the invention.
Figure 4:
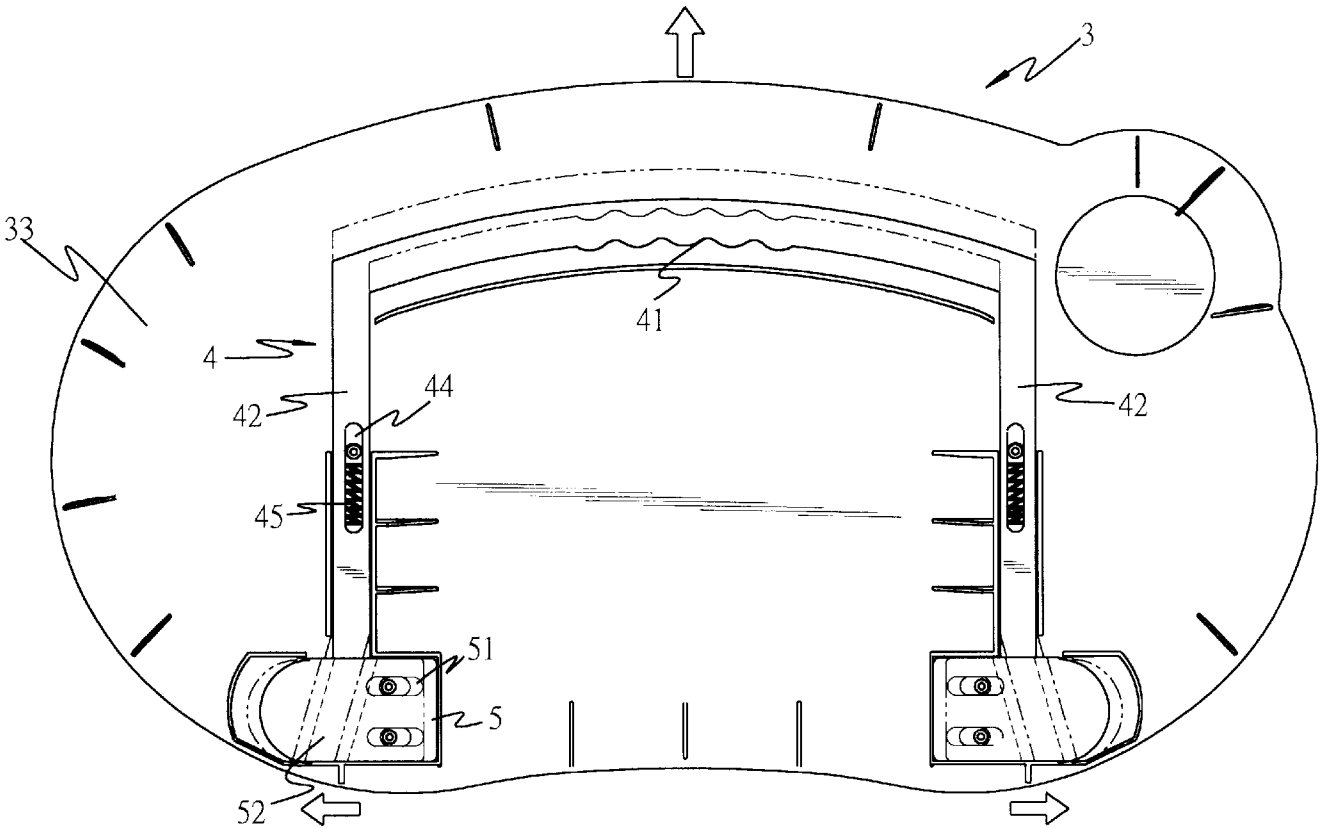
FIG. 4 is a schematic view of the invention in an operating condition.
Figure 5:
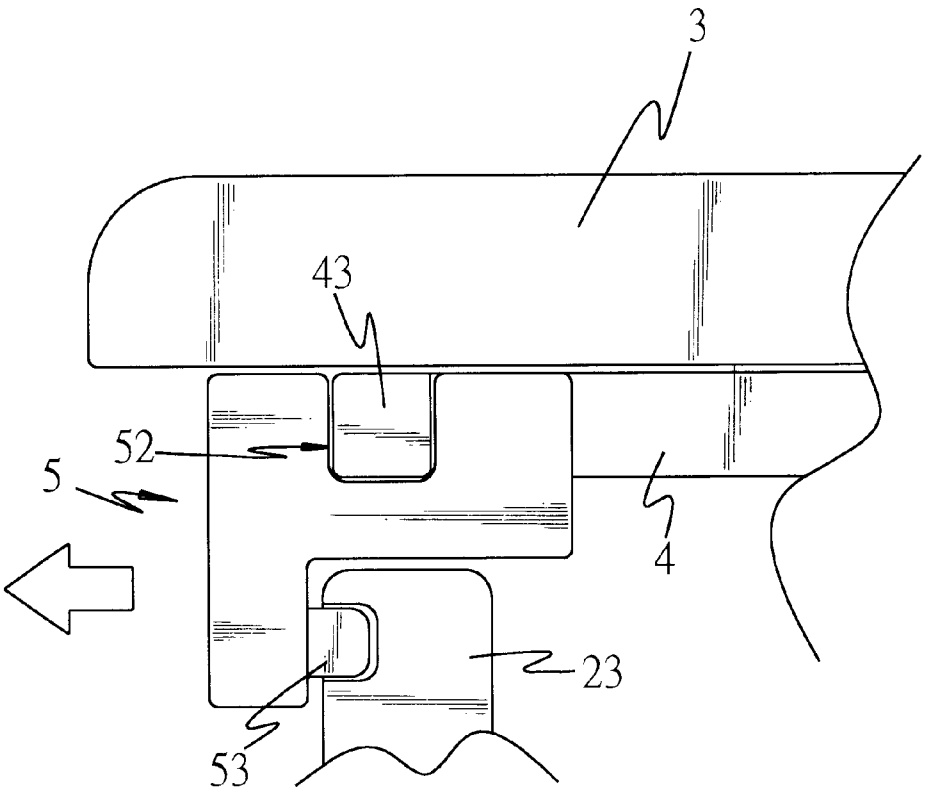
FIG. 5 is a schematic view of the invention in another operating condition.

Referring to FIGS. 3, 4 and 5, the food tray 3 is formed in an integrated manner with a plane 31 and an opening 32 for holding food or drinks. The food tray has a bottom surface 33 opposite to the plane 31 with jutting ribs integrally formed thereon. The jutting ribs form a stopping section 34, first guiding troughs 35 and second guiding troughs 36. The first guiding troughs 35 and the second guiding troughs 36 each has an anchor block 37 located therein.

The handle 4 is located below the food tray and is movable longitudinally and reciprocally. In an embodiment of the invention, the handle is formed substantially in a "⊓" shape with the transverse section forming a handgrip section 41 to enable users to grasp and operate. The handgrip section 41 has two ends extended to form two longitudinal sections 42. Each longitudinal section 42 has one end forming a biased end 420 with a skew angle about 5 to 45 degrees (depending on the driving distance of the sliding dock) to form a sliding rail 43. The handle 4 is installed within the range of the first guiding trough 35 on the bottom surface 33. The longitudinal sections 42 have elongated troughs 44 formed on desired locations matching the anchor block 37, and by means of screws the handle 4 may be positioned on the bottom surface 33. Each of the elongated troughs 44 of the longitudinal sections 42 has an elastic element 45 located therein to enable the handle 4 be moved reciprocally and longitudinally parallel with the bottom surface 33.

A pair of sliding docks 5 are provided that each has an elongated trough 51, and are fastened to two sides of the bottom surface 33 of the food tray 3 at locations corresponding to where the armrests 23 are to be mounted. Furthermore, the sliding docks 5 have coupling troughs 52 corresponding to the sliding rails 43 that also have the same type of biased surface such that when the handle 4 and the sliding rails 43 are moved, the sliding docks 5 are moved transversely outwards. In addition, in order to reduce friction and to make moving smooth, the coupling troughs 52 have jutting ribs 521 on their inner surfaces to reduce contact with the sliding rails 43. Moreover, the sliding docks 5 have integrally forming latch lugs 53 that are latched on the coupling sections 24 of the armrests 23 in normal conditions. When a user wants to adjust the position of the food tray 3, s/he pulls the handle 4, the sliding rails 43 of the longitudinal sections 42 push the sliding docks 5 outwards simultaneously, and the latch lugs 53 are moved away from the coupling sections 24. Thus the distance between the food tray 3 and the backrest 22 may be adjusted.

By means of the construction set forth above, the invention provides a pair of sliding rails with a biased surface on two ends of the handle to move the sliding docks at the same time so that the latch lugs may be separated from the harness of the armrests at two sides. Thus adjustment of the food tray can be done easily.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A food tray adjustment structure for a high chair located between a chair supported by a high chair frame and a food tray for controlling relative movement and positioning between the chair and the food tray, the chair having armrests on two sides thereof, each armrest having a plurality of indented or jutting sections to form a coupling section, the adjustment structure comprising:

a handle located below the food tray and being movable longitudinally and reciprocally, and having a hand grip section for moving and controlling the handle, a pair of longitudinal sections parallel with the armrests each having a biased end which forms a sliding rail with a skew angle from 5 degrees to 45 degrees against a longitudinal direction of the handle;

a sliding dock having a latch section engageable with the coupling section and being mounted below the food tray and movable transversely and reciprocally, the sliding dock being coupled with the sliding rail and being driven by the sliding rail to move transversely and reciprocally while the handle is moved reciprocally to allow the latch section to engage with or separate from the coupling section; and a spring pressing the sliding dock towards the coupling section to maintain an elastically latched condition for the adjustment structure;

wherein the sliding dock has a coupling trough which has an inner surface with jutting ribs formed thereon to reduce contact area with the sliding rail for reducing friction force.

2. The food tray adjustment structure for a high chair of claim 1, wherein a bottom surface of the food tray has a first guiding trough and a second guiding trough to facilitate respectively sliding and anchoring of the handle and the sliding dock.

3. The food tray adjustment structure for a high chair of claim 1, wherein the handle is integrally and substantially formed in U shape.

4. The food tray adjustment structure for a high chair of claim 1, wherein the handle and the sliding dock have an elongated trough matching an anchor block located on the food tray for positioning so that the handle and the sliding dock are movable within a range of the elongated trough.

5. The food tray adjustment structure for a high chair of claim 1, wherein the spring is located between the sliding dock and the food tray.

6. The food tray adjustment structure for a high chair of claim 1, wherein the spring is located between the handle and the food tray.

* * * * *